US005109555A

United States Patent [19]

Fickler

[11] Patent Number: 5,109,555

[45] Date of Patent: May 5, 1992

[54] SCOOP LITTER TO TRANSPORT AN INJURED PERSON

[76] Inventor: Hans Fickler, Weidstrasse 18, CH-8542 Wiesendangen, Switzerland

[21] Appl. No.: 455,389

[22] PCT Filed: May 24, 1989

[86] PCT No.: PCT/CH89/00095

§ 371 Date: Jan. 18, 1990

§ 102(e) Date: Jan. 18, 1990

[87] PCT Pub. No.: WO89/11263

PCT Pub. Date: Nov. 30, 1989

[30] Foreign Application Priority Data

May 27, 1988 [CH] Switzerland ..... 2009/88

[51] Int. Cl.[5] ..... A61G 1/013

[52] U.S. Cl. ..... 5/81.1

[58] Field of Search ..... 5/82 R, 82 B, 60

[56] References Cited

U.S. PATENT DOCUMENTS

| | | | |
|---|---|---|---|
| 2,391,928 | 7/1946 | Seib | 5/82 R |
| 3,653,079 | 4/1972 | Bougraf et al. | 5/82 R |
| 3,921,231 | 11/1975 | Bougraf et al. | 5/82 R |
| 4,480,345 | 11/1984 | Dunn | 5/82 R |
| 4,744,116 | 5/1988 | Shirazi | 5/82 R |

FOREIGN PATENT DOCUMENTS

| | | | |
|---|---|---|---|
| 0110851 | 11/1984 | European Pat. Off. . | |
| 481154 | 9/1916 | France . | |
| 1319338 | 7/1963 | France . | |
| 2098173 | 4/1971 | France . | |
| 2587898 | 4/1987 | France | 5/82 R |
| 8800461 | 1/1988 | PCT Int'l Appl. | 5/82 R |

*Primary Examiner*—Alexander Grosz

*Attorney, Agent, or Firm*—Speckman & Pauley

[57] ABSTRACT

A scoop litter that permits the passage of X-rays along the side of a patient on the litter. Only the end pieces and the connecting elements of the litter are made of metal. This has the advantage that X-rays may be taken from both the vertical as well as the lateral plane of a patient lying on the litter. Such aspect is particularly advantageous in cases of spinal injuries.

11 Claims, 2 Drawing Sheets

SCOOP LITTER TO TRANSPORT AN INJURED PERSON

BACKGROUND OF THE INVENTION

The invention relates to a scoop litter for the transporting an injured person. There are principally two types of litters and namely rigid, possibly folding litters, to use in which, the injured person must be lifted up and placed on the litter. In the second type, the so-called "scoop litter" which is divided along its longitudinal axis, the longitudinal braces are equipped with support elements, which can be pushed under the injured person like a series of scoops, without the person having to be lifted in order to perform this action. Such scoop litters are extremely useful in cases where the injured person has suffered a spinal injury. In these cases, incorrect lifting can be extremely dangerous to the injured person. This is true not only for transport from the scene of the accident to the hospital, but also during treatment at the hospital itself. This is because at the hospital, an x-ray is first taken, in order to determine the nature and extent of the injury. A first observation generally takes place while the injured person is still lying on the litter on which the patient was brought to the hospital. Present designs of scoop litters only permit this to a limited extent. X-rays can only be taken vertically to the support surface of the litter. X-rays cannot be taken from the sides since the metallic parts, and in particular the braces of the litter, are made of metal. An X-ray picture taken from the side is often insufficient to determine the exact location of the injury.

If an X-ray must be taken from the side, the patient must be lifted off the litter on which he was brought into the hospital, which under certain circumstances, can be dangerous to the patient.

SUMMARY OF THE INVENTION

Therefore, it is one object of the invention to provide a scoop litter which will permit both vertical and side X-rays to be taken. This represents a great improvement for the patient, for the personnel and for the radiologist and also reduces the risk to the patient. It is a necessity to take X-rays of a person lying on a litter. Thus, for example EU-A-0110 851 describes a litter to which support elements made of plastic can be retrofitted for this purpose. Nonetheless, even with the retrofit such litter does not fulfill the above-mentioned requirements, because it does not permit X-rays to be taken from the side. In addition, this litter is designed solely for use within the hospital and is not a litter which permits the conveyance from the scene of the accident to the hospital which permits a subsequent X-rays examination at the hospital without the patient having to be lifted from the litter. The manufacture of a litter which permits X-rays to be taken from the side of the patient lying upon it has only become possible through the use of recently developed materials for the braces.

The connection of the bearing elements to the braces, especially where these are intended to pivot, also presents certain difficulties because of occurring high local loads.

The invention solves the above object of this invention with the litter having a rectangular, tubular frame which can be divided along its longitudinal axis. The length and width of the tubular frame are dimensioned to accommodate the form of a human. At least the middle portion of the longitudinal braces of the frame and the attached support elements are constructed only of non-metallic material which allows the passage of X-rays to permit radiological examination from all sides of a patient lying on the litter.

The problem which arises if the support elements are also to be able to individually pivot is solved by retaining blocks being firmly attached to the longitudinal braces and by the support elements being removably attached.

BRIEF DESCRIPTION OF THE DRAWINGS

The enclosed drawings show one embodiment in accordance with the object of the invention, wherein.

DESCRIPTION OF THE PREFERRED EMBODIMENTS

Figure 1A:
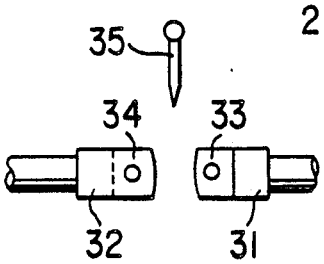
FIG. 1A shows a view of coupling parts for frame tubes.
Figure 1:
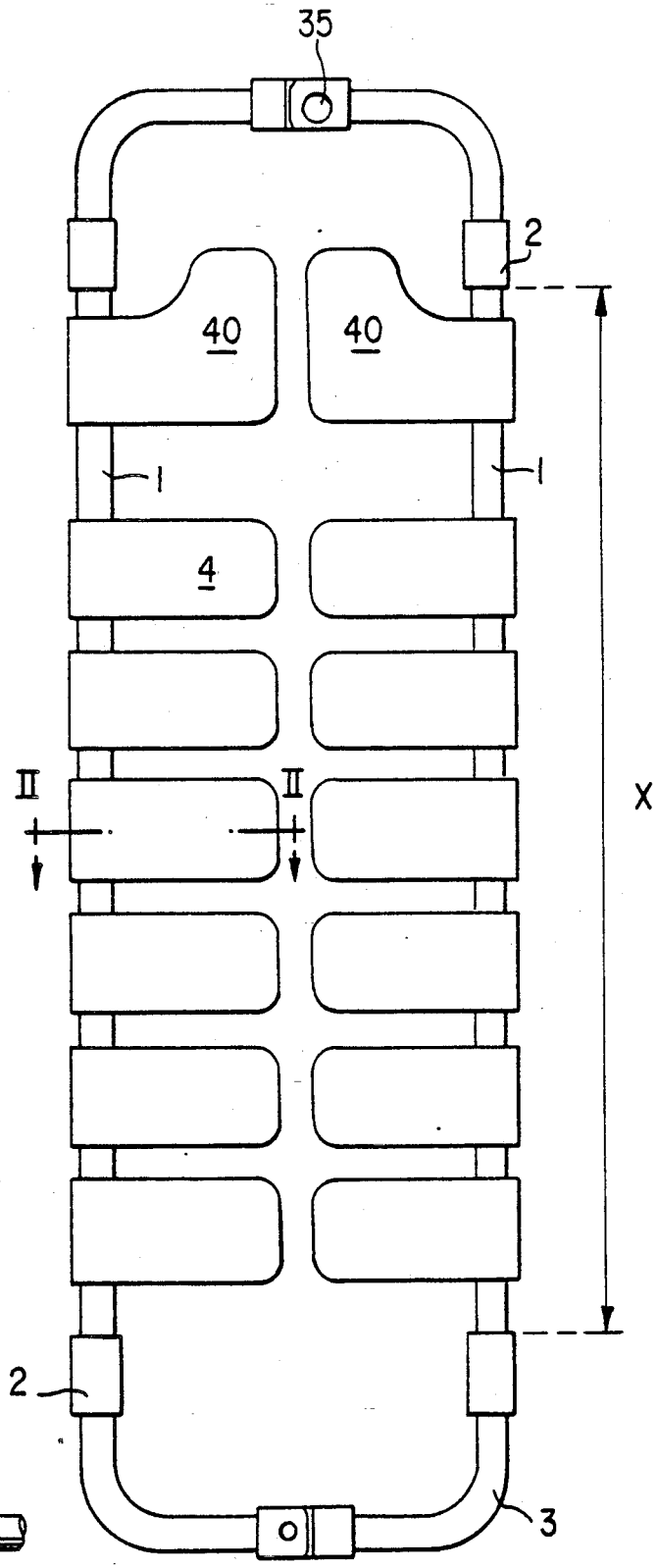
FIG. 1 shows a top view of the scoop litter.

The scoop litter shown in FIG. 1, which can be divided along its longitudinal axis, has no metal parts in the area X, so that X-rays can be taken from the side of a patient lying on the scoop litter. Only the end pieces at the head and foot of the scoop litter are made of metal.

The two braces 1 consist of fiber-reinforced plastic tubes. It is important that the fiber-reinforcement consist of layers which are wrapped crosswise because the tubes must be inflexible and must be able to transfer torsional forces to the end pieces.

Figure 2:
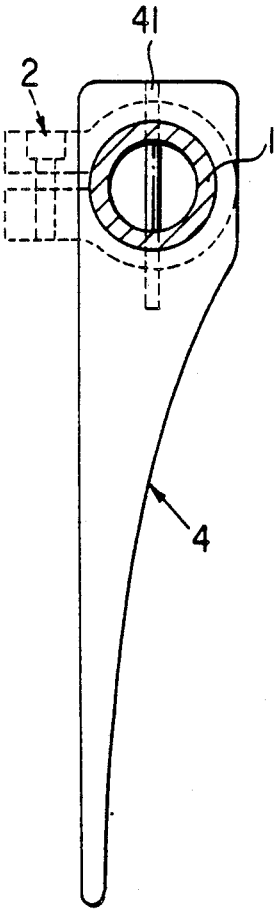
FIG. 2 shows an enlarged view of a cross-section of a fixed support element along the line II—II as shown in FIG. 1.

The braces 1 are connected to the end pieces with metallic clamp sockets which are pinned for added security. The end pieces consist of light metal tubes 3 bent at right angles one end of each of the tubes (3) is connected to the braces by the sockets 2 and the other end is equipped with coupling parts 31, 32. These coupling parts permit the longitudinal separation, which is vital to the operating characteristics of the litter, and also permit a secure connection between the two halves of the litter which is, however, rigid in the direction of the load. Coupling part 31 exhibits a flattened portion 33 with a drilled hole. The other coupling part 32 has a very deep groove 34 and the flanks have a drilled hole. When the two halves of the litter are joined, the coupling parts 31, 32 can be easily pushed together, whereby the flattened portion 33 slides into the groove 34. A pin with a knob 35 is then inserted through the holes and holds the two halves of the litter securely and, in the direction of the load, vertical with respect to the plane of the drawing, inflexibly together. In FIG. 2, a clamp socket 2 is shown by dashed lines.

Depending on the design of the litter, the support elements can be either fixed rigidly or so as to pivot on the braces. The pivoting design, although more complicated, has the advantage that patients lying on the bar can be washed, disinfected and eventually even operated upon by simply pivoting downward several support elements beneath the patient, at the patient's back side, all without lifting the patient from the litter.

FIG. 1 shows a litter with support elements 4 fixed firmly to the braces. Two flared support elements 40 for the patients head are mounted at the head end.

FIG. 2 shows a support element 4 which is immovably connected to the brace and which is pinned to the brace 1 with two plastic pins 41 set at a certain distance from one another. Plastic or wood, for example ash, are suitable materials for the support elements.

Figure 3:
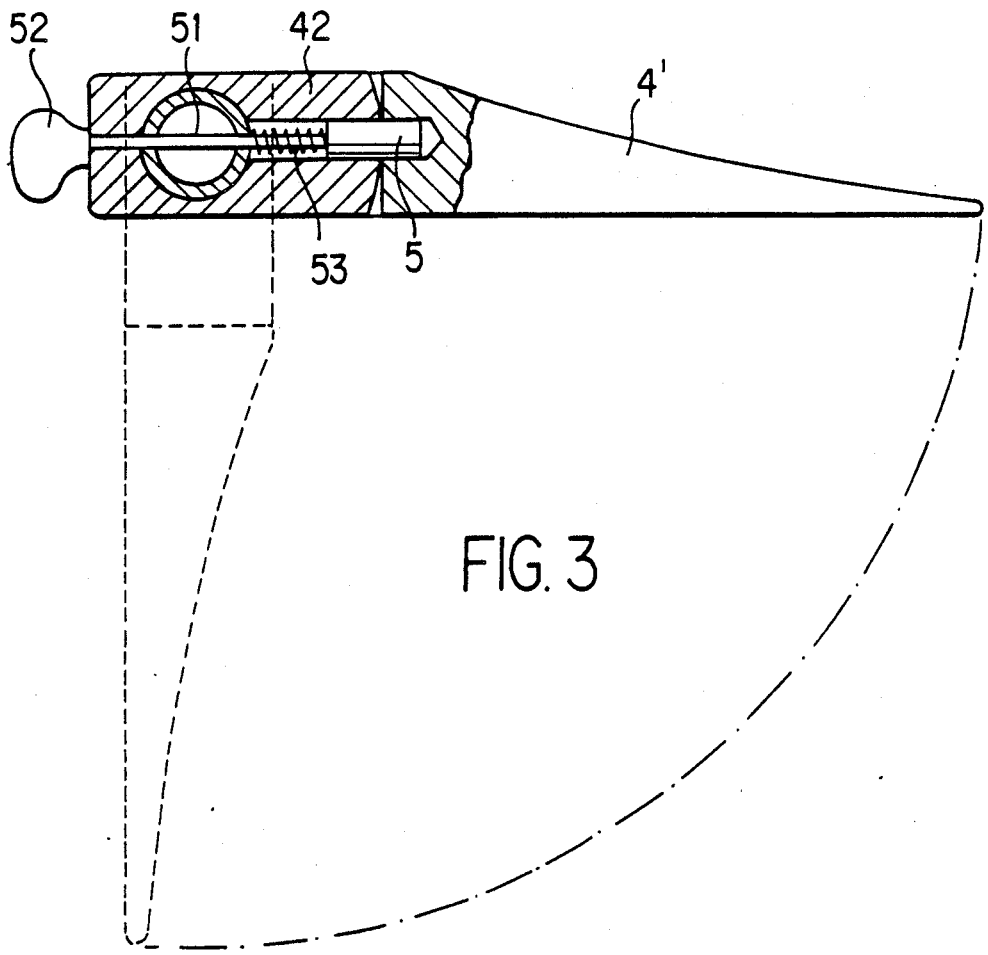
FIG. 3 shows a cross-sectional view of the fixed support element as shown in FIG. 2 but through a pivoting support element.
Figure 4:
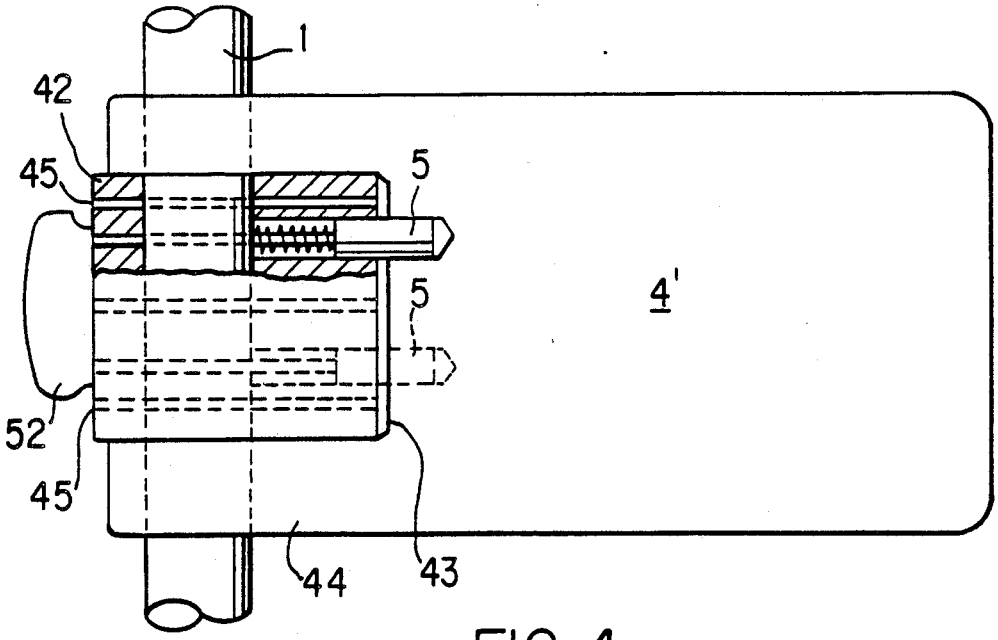
FIG. 4 shows a top view of a support element as shown in FIG. 3.

FIGS. 3 and 4 show a support element 4' which pivots downwards. The support element 4 pivots around the brace 1. For this reason, a retaining block 42 is attached to the brace 1 with three pins 45. The support element 4' is held in a rest position by two spring-loaded detent pegs 5. The actuator bars 51 for the pegs 5 have a smaller diameter than the pegs 5 and therefore weaken the brace less. A handle 52 is mounted on the outside of the retaining block 42, with which the two pegs 5 can be simultaneously drawn out of the support element 4' against the force of the springs 53, so that the support element 4' can be rotated downwards. The support element 4' is equipped with a recess 43 so that the two side pieces 44 surround the retaining block 42 and pivot around the brace 1 in the manner of a hinge. This exclusive design had to be selected so that the detent pegs 5 are further away from the pivoting axis, the center of the brace 1, which causes the shear forces on the pegs 5 to be reduced. The shear force can, under certain circumstances, reach very high levels, particularly when a patient lying on the litter sits up, at which point the patients entire weight rests on only two opposing support elements.

Not only does the shear force in the bolts 5 reach high levels when this occurs, but the material load in both the retaining block 42 and in the support element becomes high. Since, however, these are not metal parts, but rather are plastic parts or wood parts, more than one bolt 5 must be used in order to ensure sufficient safety.

What is claimed is:

1. A litter for transporting an injured person, the litter comprising: a frame having a plurality of longitudinal braces (1), a plurality of support elements (4) pivotally attached with respect to said longitudinal braces (1) along a length of each said longitudinal brace (1), said support elements (4) and said longitudinal braces (1) consisting of non-metallic material thereby permitting passage of X-rays, a retaining block (42) secured to a corresponding said longitudinal brace (1), two side supports (44) of said support element (4) forming a recess (43) within which said retaining block (42) is positioned, said support element (4) having a bore, and a removably spring-loaded peg (5) normally urged within said bore into a locked position between said support element (4) and said retaining block (42) for fixing said support element (4) with respect to said retaining block (42).

2. A litter in accordance with claim 1, wherein said longitudinal braces (1) are each constructed of a plastic tube reinforced by fibers wrapped in a crosswise manner.

3. A litter in accordance with claim 2, wherein head and foot ends (3; 31–35) are constructed of metal and are connected to brace ends of said longitudinal braces (1) with pinned clamp sockets (2).

4. A litter in accordance with claim 1, further comprising a plurality of pins (45) each passing through a corresponding said longitudinal brace (1) and a corresponding said retaining block (42) for securing each said retaining block (42) with respect to each corresponding said longitudinal brace (1).

5. A litter in accordance with claim 1, wherein said support elements (4, 4') are constructed of wood.

6. A litter in accordance with claim 1, wherein said support elements (4, 4') are constructed of plastic.

7. A litter in accordance with claim 1, wherein head and foot ends (3: 31–35) are constructed of metal and are connected to brace ends of said longitudinal braces (1) with pinned clamp sockets (2).

8. A litter in accordance with claim 1, wherein each said spring-loaded peg (5) further comprises an actuator bar (51) secured to said peg (5), and a spring (53) positioned about said actuator bar (51).

9. A litter in accordance with claim 8, wherein said spring (53) is positioned between said longitudinal brace (1) and said peg (5).

10. A litter in accordance with claim 8 further comprising a handle (52) secured to said actuator bar (51) for removing said peg (5) from said bore within said support element (4).

11. A litter in accordance with claim 1, wherein said retaining block (42) has a through hole for accommodating said peg and an axis of said through hole is transverse with respect to a longitudinal axis of said longitudinal brace (1).

* * * * *